US005501682A

United States Patent [19]

Edwards-Cofie

[11] Patent Number: 5,501,682

[45] Date of Patent: Mar. 26, 1996

[54] MULTI PURPOSE VIBRATING FOOT STOOL

[76] Inventor: Sophia Edwards-Cofie, 17 Desert Sand Dr., Brampton, Ontario, Canada, L6R 1V5

[21] Appl. No.: 74,466

[22] Filed: Jun. 10, 1993

[51] Int. Cl.[6] ..... A61H 1/08

[52] U.S. Cl. ..... 601/61; 601/49; 601/16; 132/73.5

[58] Field of Search ..... 601/15–17, 27–32, 601/46, 61, 62, 64, 65, 66, 49, 78, 67–70; 132/73, 73.5, 75; 297/423.41, 423.45

[56] References Cited

U.S. PATENT DOCUMENTS

| | | | |
|---|---|---|---|
| 2,199,895 | 5/1940 | Sharp | 297/423.41 X |
| 2,914,116 | 11/1959 | Göhmann | 297/423.41 X |
| 3,043,294 | 7/1962 | Neff | 601/61 |
| 3,051,527 | 8/1962 | McKenna | 297/439 |
| 3,163,468 | 12/1964 | Koch | 297/439 |
| 3,264,033 | 8/1966 | Hansburg | 297/438 |
| 3,304,935 | 2/1967 | Kennedy et al. | 601/27 X |
| 3,366,105 | 1/1968 | Sadowski et al. | 601/16 |
| 3,478,703 | 11/1969 | Weinstein | 132/75 |
| 3,683,896 | 8/1972 | Peplin | 601/16 |
| 3,942,520 | 3/1976 | McNair | 601/15 |
| 4,294,268 | 10/1981 | Kitrell | 132/73 |
| 4,296,766 | 10/1981 | Benis | 132/73.5 |
| 4,492,221 | 1/1985 | Kerley | 601/16 X |
| 4,813,966 | 10/1989 | Gitter | 601/22 X |
| 5,139,036 | 8/1992 | Pickard | 132/73.5 |

FOREIGN PATENT DOCUMENTS

| | | | |
|---|---|---|---|
| 2220156 | 11/1973 | Germany | 297/423.45 |
| 2300085 | 7/1974 | Germany | 297/423.45 |
| 0784863 | 12/1980 | U.S.S.R. | 297/423.45 |
| 1213251 | 11/1970 | United Kingdom | 297/423.45 |

*Primary Examiner*—Robert A. Hafer
*Assistant Examiner*—Brian E. Hanlon
*Attorney, Agent, or Firm*—Swabey Ogilvy Renault

[57] ABSTRACT

A cosmetic foot stool for grooming and massaging the feet comprises a foot support mounted to a base with the foot support being adjustable in height with respect to the base in order that the user may position the foot support in such a way that it is comfortable during use. The foot support defines a recess in an upper surface thereof for receiving a foot of the user. The recess has an inclined surface for receiving the sole of the foot. This inclined surface faces towards the user so that the foot is perpendicular to the line of vision of the user. The foot support is provided with a vibrating device which can be connected to a shoe into which the user can position his foot for receiving a massage. As the foot stool is used for grooming the feet and, for instance, for applying nail polish to the toes thereof, a blower is provided in the foot support with apertures being defined in the inclined surface thereof in such a way that air displaced by the blower flows through the apertures. A deflector is positioned on top of the inclined surface to redirect this air towards the recess and thus towards the user's toes. Circular recesses are defined in the foot support for receiving various items which are used during the grooming of the feet, such as nail polish bottles. An orientable lamp is provided on the foot support for the user's convenience.

10 Claims, 4 Drawing Sheets

MULTI PURPOSE VIBRATING FOOT STOOL

BACKGROUND OF THE INVENTION

1. Field of the Invention

The present invention relates to foot stools and, more particularly, to a foot stool having foot grooming and massaging facilities.

2. Description of the Prior Art

Various foot stool constructions have been proposed over the years for varying the vertical position of the support surface. For example, U.S. Pat. No. 3,051,527 issued on Aug. 28, 1962 to McKenna discloses a foot stool having a vertical frame with a horizontal foot support slidable thereon which can be maintained in a selected vertical position by way of a downward tilt thereof which is induced by the foot support's own weight. The foot support is thus frictionally held in the adjusted position.

Also, in U.S. Pat. No. 3,264,033 issued on Aug. 2, 1966 to Hansburg, there is disclosed a somewhat similar foot stool which has its horizontal support pivotally mounted to the frame and which can be vertically adjusted by way of telescopic legs.

U.S. Pat. No. 3,163,468 issued on Dec. 29, 1964 to Koch discloses a foot stool having a horizontal support portion which is hinged to the frame and which can be frictionally adjusted at different angular positions by way of a substantially vertical rod which extends from a bottom of a free end thereof opposite its hinged end and which engages an opening defined in an elongated latch or clutch member which extends substantially horizontally inwards from a horizontal rod connecting a pair of consecutive vertical side members of the foot stool. The latch is pivotally mounted to the connecting rod whereby a gravity-induced deflection thereof clutches the vertical rod in its opening in a frictional engagement.

All of the above foot stools offer a different mechanism to ensure the vertical adjustability of the foot supporting surface thereof. However, none of these foot stools are of a design dedicated to facilitate the grooming and massaging of the feet.

SUMMARY OF THE INVENTION

It is therefore an aim of the present invention to provide a foot stool which is designed for the grooming and massaging of the feet.

It is also an aim of the present invention to provide a foot stool which is designed to facilitate pedicures and to facilitate the application of nail polish to the feet and the drying thereof.

Therefore, in accordance with the present invention, there is provided a foot stool which comprises a foot support means mounted to a base means with the support means being adjustable in height for the user's comfort. The support means defines a recess in an upper surface thereof for receiving a foot of the user. The recess has an inclined surface facing towards the user, wherein the foot overlying the inclined surface is substantially perpendicular to the line of vision of the user. Therefore, the user's foot can be positioned in the recess for being worked on.

In a more specific construction in accordance with the present invention, the support means is provided with a blower means for drying substances applied to the foot. The lower means can be mounted in the support means with apertures being defined in the inclined surface and a deflector means being provided on the support means for deflecting the air displaced by the blower means through the apertures towards the foot.

In a still more specific construction in accordance with the present invention, the deflector means is an elongated member of inverted "L" shaped cross-section and mounted to the inclined surface in order that the apertures are positioned between the elongated member and the foot. A series of circular recesses can be defined in the support means for receiving foot grooming items, such as nail polish bottles.

In another specific construction in accordance with the present invention, a vibrating means is mounted to the support means for massaging the foot.

In a more specific construction, the vibrating means is mounted in the support means and includes a coupling means. An opening is defined in the inclined surface opposite the coupling means. A shoe means is adapted to receive the foot and to be connected through the opening to the coupling means. Therefore, vibrations produced by the vibrating means are transmitted to the shoe and thus to the foot.

In another specific construction in accordance with the present invention, an orientable lamp is mounted to the support means.

In a further specific construction in accordance with the present invention, the base means comprises a pair of parallel "L" shaped members each having an horizontal section overlying the floor and a vertical section extending upwards therefrom. Horizontal cross members join respective upper and lower free ends of the pair of "L" shaped members. The vertical sections extend through vertical openings defined in the support means with the upper cross member being located above the support means. The support means project as a cantilever from the vertical sections, whereby gravity causes the support means to pivot downwards with respect to the vertical sections. The friction between the vertical sections and the openings maintain the support means secured to the base means at a selected height.

In a still more specific construction in accordance with the present invention, sleeves are provided in the openings, whereby the vertical sections coact with the sleeves. The sleeves can be made of a high friction plastics material.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION QF THE PREFERRED EMBODIMENTS

Figure 4:
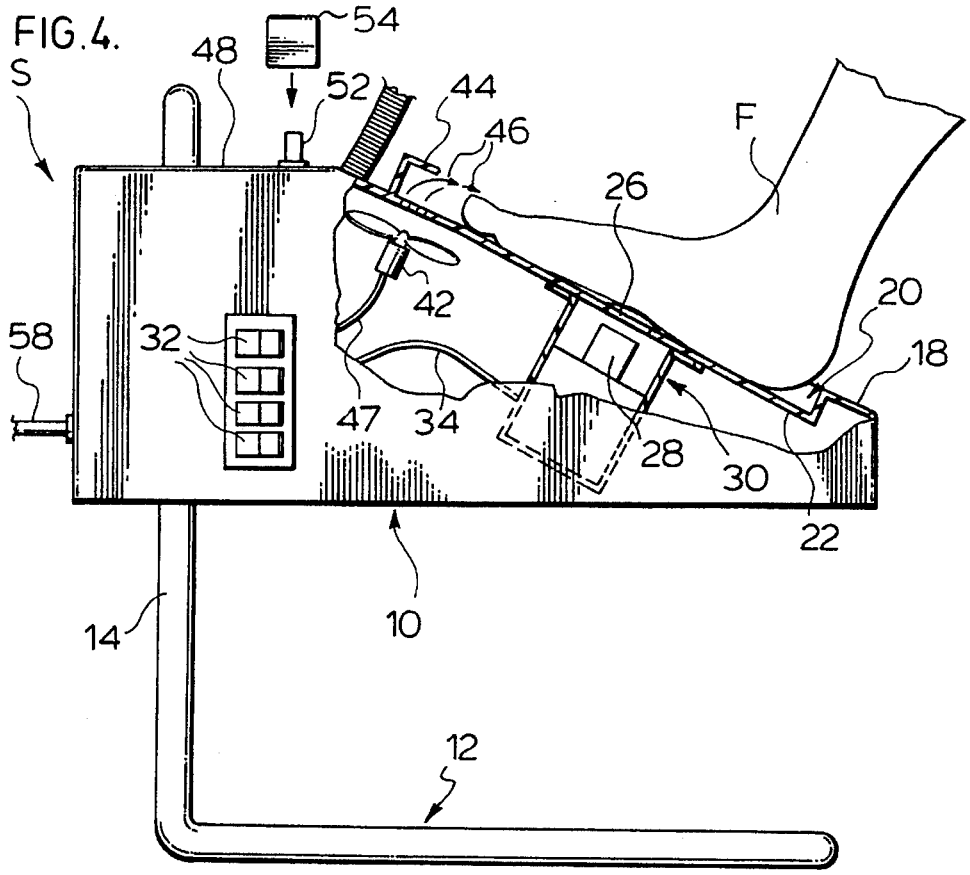
FIG. 4 is a fragmented side view of the foot stool in a nail polish drying mode thereof.

Referring to FIGS. 1 to 4, a foot stool S in accordance with the present invention and intended for cosmetic purposes comprises a foot support 10 mounted at a distance from the floor to a base 12 made of tubular steel and having a pair of vertical elongated members 14 extending through a pair of elongated vertical openings defined at the rear of the foot support 10. The foot support 10 can be positioned all along the vertical members 14, as it will be explained in details hereinafter, whereby the foot stool S can be adjusted to ensure that the user is comfortable.

An upper inclined surface 18 of the foot support 10 defines a foot receiving recess 20 having the general outline of a "V", the apex of which is rounded. The recess 20 has an inclined bottom surface 22 and sidewalls 24 extending at right angles therefrom, with the side walls 24 tapering in height from the rounded apex towards the upper ends of the "V". The portion of the sidewalls 24 located at the rounded apex of the recess 20 provides a support for the back of the foot of the user when positioned in the recess 20. An opening 26 which is defined in the bottom wall 22 of the recess 20 is aligned with a coupling 28 of a vibrating device 30 mounted within the foot support 10 below the upper inclined surface 18 thereof. The vibrating device 30 is connected to one of a series of switches 32 by way of an electric cord 34. Now referring only to FIG. 2, a shoe 36 which can be fitted around a foot F of the user includes a connecting pin 38 at its bottom which, when inserted and coupled to the coupling 28, will transmit the vibrations produced by the vibrating device 30 to the shoe 36 and thus to the foot F for massaging the same.

Figure 3:
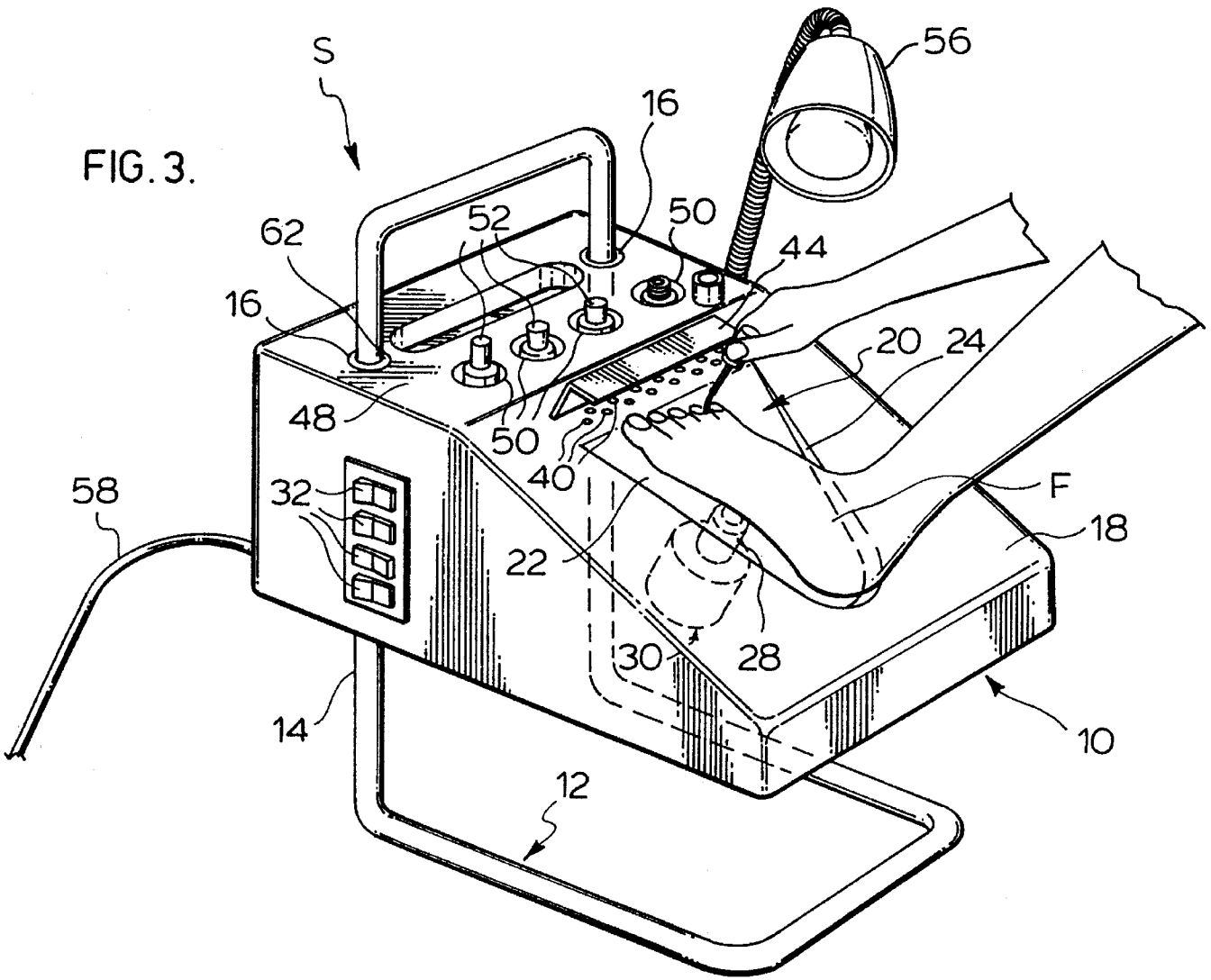
FIG. 3 is a perspective view of the foot stool being used for applying nail polish to the foot of the user.

Now referring to FIGS. 3 and 4, a series of apertures 40 are defined in the upper inclined surface 18, just above the recess 20. Within the foot support 10, there is provided a blower 42 which is positioned in order that air displaced thereby flows upwards through the apertures 40. A deflector 44 which has an inverted "L" shape is mounted on the upper inclined surface 18, above the apertures 40, for deflecting the air flowing through the apertures towards the toes of the user's foot F (see arrows 46) in order, for instance, to accelerate drying of nail polish applied thereto. The blower 42 is connected by an electric cord 47 to one of the switches 32.

Figure 1:
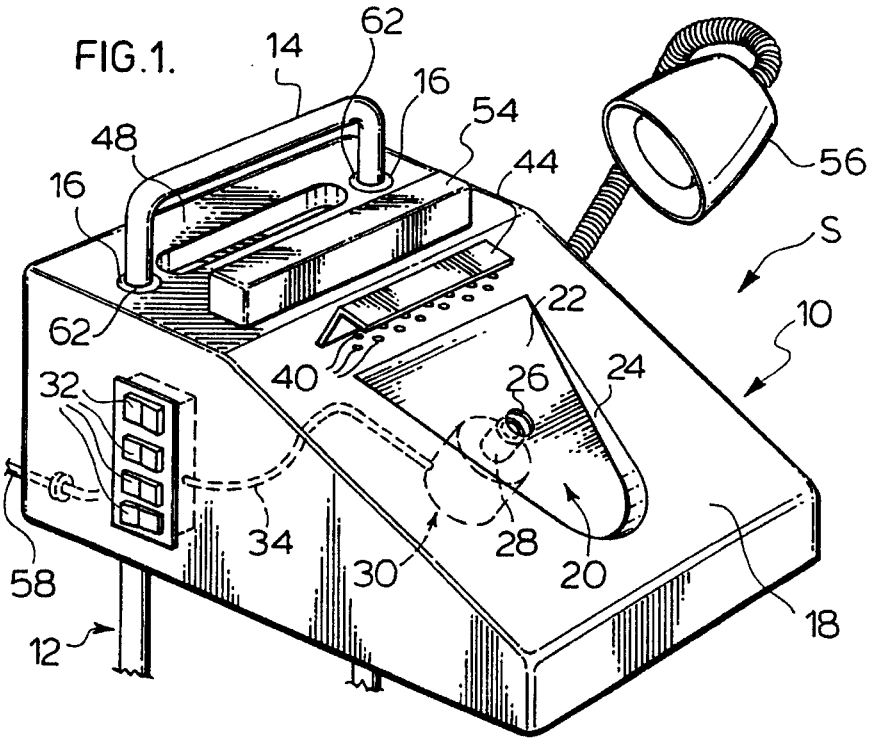
FIG. 1 is a perspective view of a foot stool in accordance with the present invention.

A horizontal upper surface 48 of the foot support 10 defines a series of aligned circular recesses 50 adapted to receive therein, for example, nail polish bottles 52, as seen in FIG. 3. As best seen in FIGS. 1 and 4, a removable cover 54 is positioned over the recesses 50 and thus over the bottles 52.

A lamp 56 which can be conveniently oriented to the user's preference is mounted to the foot support 10. The lamp 56 is controlled by one of the switches 32. Electrical power is supplied to the foot stool S by a cord 58 connected to the switches 32.

Figure 2:
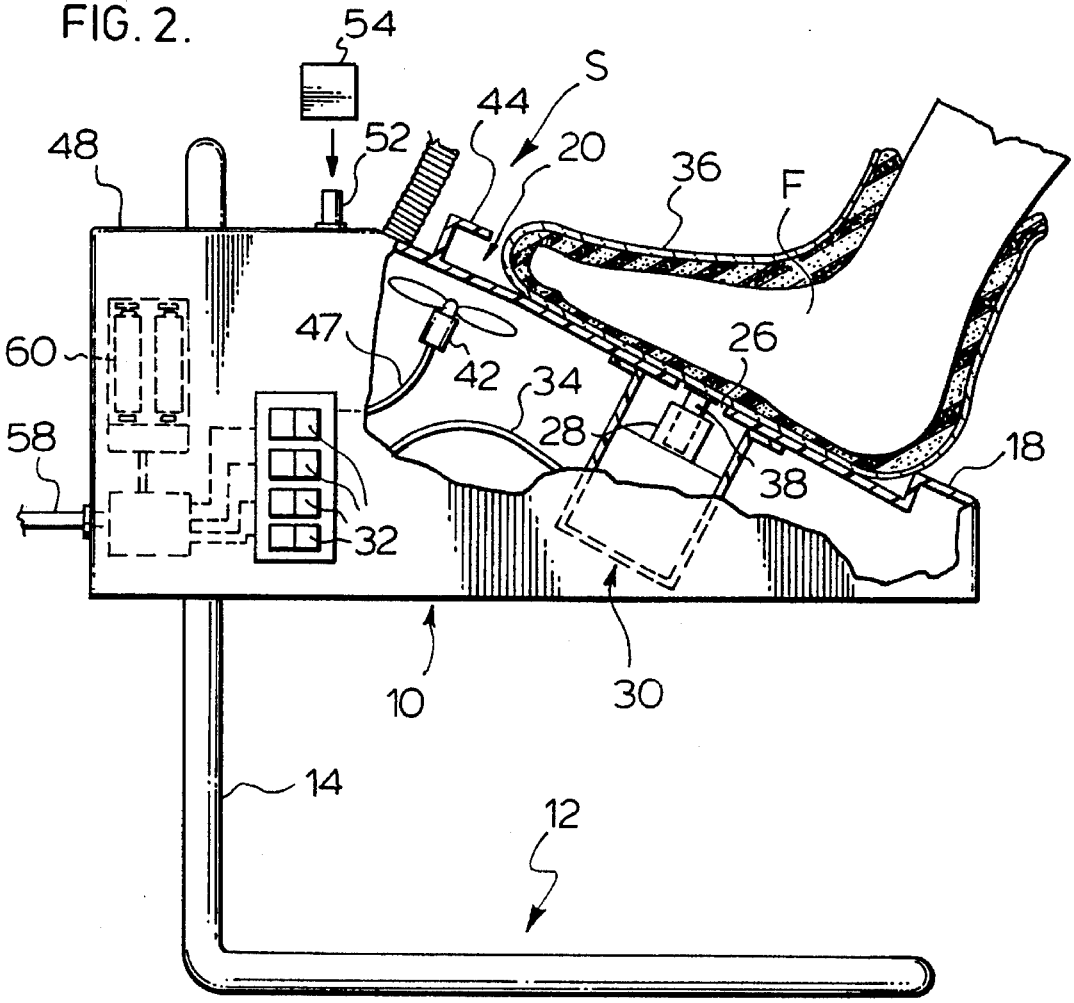
FIG. 2 is a fragmented side view of the foot stool in a foot massaging mode thereof.

As seen in FIG. 2, a battery pack 60 may be provided for operating the vibrating device 30, the blower 42 and the lamp 56 in locations where an electric wall outlet might not be readily available.

Figure 5:
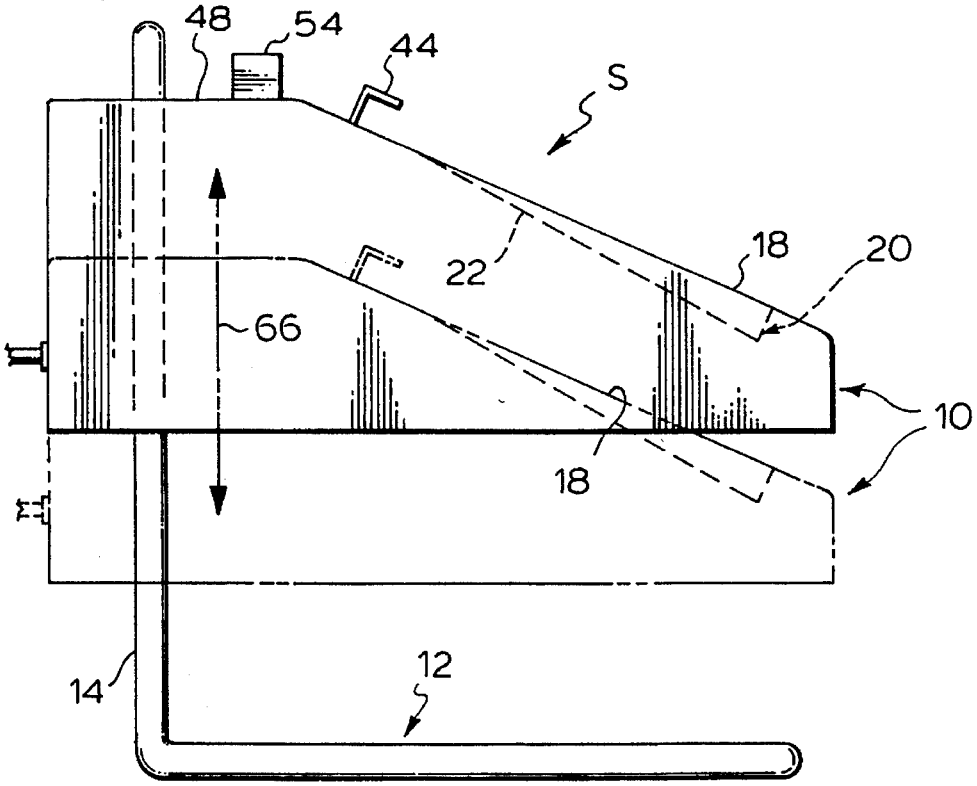
FIG. 5 is a side elevation view of the foot stool showing the vertical adjustability thereof.
Figure 6:
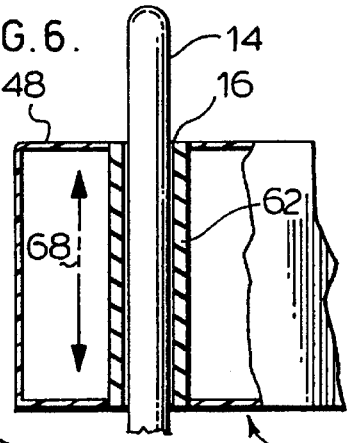
FIGS. 6 and 7 are side elevation views of parts of the foot stool showing respectively positions thereof wherein the foot stool is free to be vertically adjusted and wherein the foot stool is in a locked position at a desired height.
Figure 7:
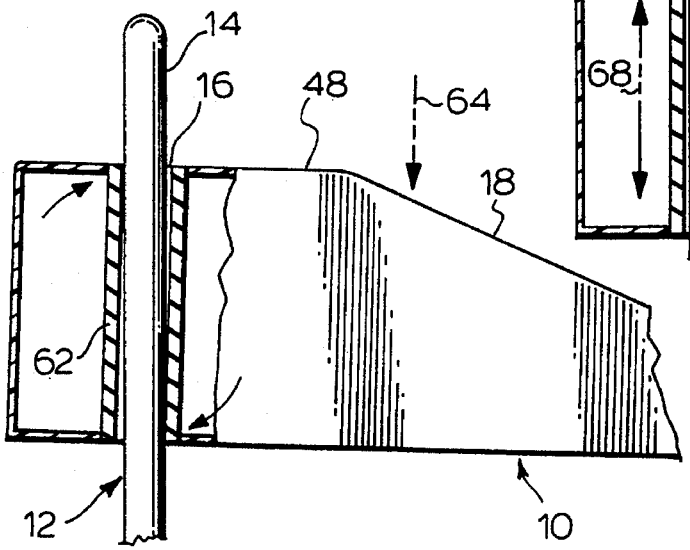

Now referring to FIGS. 5 to 7, the foot support 10, as mentioned hereinabove, can be vertically adjusted along the elongated members 14 of the base 12. This is achieved with a pair of sleeves 62 mounted in the foot support 10 and coaxial with the openings 16 thereof, as best seen in FIGS. 6 and 7. The inside diameter of the sleeve 62 is slightly greater than the diameter of the openings 16, whereby the foot support 10, extending as a cantilever from the base 12, pivots slightly downwards at its front end, as indicated by arrow 64 in FIG. 7, and is held in position by the friction forces between the elongated members 14 and the sleeves 62. For that purpose, the sleeves 62 may be made of a plastics or rubber material. To be able to vertically displace the foot support 10 with respect to the base 12, the front end of the foot support 12 is slightly raised in order that the vertical elongated members 14 of the base are coaxial with the axes of the sleeves 62, as seen in FIG. 6, whereby the sleeves 62 are slidable over the elongated members 14. In this position, the foot support can be thus selectively raised or lowered along arrows 66 and 68 of FIGS. 5 and 6, respectively.

The present invention thus offers a foot stool which assists the user in a series of functions, including manicuring, the application and drying of nail polish, and foot massaging.

The present cosmetic grooming foot stool facilitates the access by the user to his or her feet. It is also very convenient to be able to elevate the stool to a height at which the user can work comfortably or at which the foot can be rested. In its collapsed position, that is when the foot support 10 overlies the horizontal tubular members of the base 12, the present foot stool can be stored easily.

The present foot stool is thus designed for toe nails and foot grooming. The recesses 50 are provided for accommodating a variety of nail grooming commodities, i.e. nail fortifier, nail polish, nail polish top coat, nail file, nail clips, scissors, cotton wool balls and nail polish remover. The intent is to give the user the convenience of having these grooming accessories readily available while the foot is elevated and being worked on.

The present foot stool also includes a blow drying feature which will decrease the nail polish drying process and save the user some valuable time.

The lamp is also an added feature which will allow the user to clearly see what he is doing even in a dark enclosure, such as a camp site, and will assist those who need that extra light for seeing.

The vibrating pad or device allows the user to undergo rotation massages on his or her feet in order, for instance, to remove tension.

The present foot stool is also designed to be easy on the neck and shoulders and on the spinal column and to prevent dizziness. Indeed, the foot stool provides the user with the choice to elevate the foot support to a desired and comfortable height for grooming sessions. This prevents the user from engaging in excessive lowering of the upper torso of the body which in turn forces the slumbering of the neck and the upper shoulders and therefore overload these areas with stress and strain. The stool is designed to relieve these problems. Also, the stool with its adjustable height assists in positioning the user's spinal column in order that it is free of strain, whereby the user will also benefit from an elimination of stress in this area during grooming.

The variable elevation feature of the present foot stool in addition to the parallelism of the foot with respect to a perpendicular line extending between the eyes of the user and the foot positioned in the recess of the foot stool will protect the user from developing the dizzy feeling associated with excessive lowering of the head for an extended period of time followed by the raising of the head to an upright position.

I claim:

1. A foot stool comprising a body means, vibrator means mounted in said body means for massaging a user's foot, said body means comprising foot support means onto which the user's foot can be positioned, shoe means being provided, said shoe means being adapted to receive the user's foot, said vibrator means and said shoe means comprising cooDerating disconnectable coupling means for coupling said shoe means to said vibrator means, said coupling means extending through an opening in said support means, said shoe means being adapted to be removably connected to said vibrator means by way of said coupling means, whereby when said shoe means and said vibrator means are connected by said coupling means, vibrations produced by said vibrator means are transmitted to said shoe means and thus to the user's foot.

2. A foot stool as defined in claim 1, wherein at least one circular recess is defined in said body means for receiving foot grooming items.

3. A foot stool as defined in claim 1, wherein an orientable lamp is mounted to said support means.

4. A foot stool as defined in claim 1, wherein said body means also comprises blower means located inside said body means, said body means defining at least one aperture means adjacent said support means and including deflector means, said blower means being adapted to direct air through said aperture means with at least part of the air flowing from said aperture means being redirected by said deflector means towards the user's foot when positioned on said support means.

5. A foot stool as defined in claim 4, wherein said aperture means comprise a plurality of apertures.

6. A foot stool as defined in claim 5, wherein said deflector means is an elongated member of inverted "L" shaped cross-section and mounted to said body means in order that said apertures are positioned between said elongated member and the foot.

7. A foot stool as defined in claim 1, further comprising base means for supporting said body means, said base means being adapted for allowing a height of said body means to be adjusted to the user's preference.

8. A foot stool as defined in claim 7, wherein said base means comprises a pair of parallel "L" shaped members each having a horizontal section overlying the floor and a vertical section extending upwards from said horizontal section, horizontal cross-members joining respective upper and lower free ends of said pair of "L" shaped members, said vertical sections extending through vertical openings defined in said body means with the upper cross-member being located above said body means; said body means projecting as a cantilever from said vertical sections, whereby gravity causes said body means to pivot downwards with respect to said vertical sections, the friction between said vertical sections and said openings maintaining said body means secured to said base means at a selected height.

9. A foot stool as defined in claim 8, wherein sleeves are provided in said openings, whereby said vertical sections coact with said sleeves.

10. A foot stool as defined in claim 9, wherein said sleeves are made of a high friction plastics material.

* * * * *